United States Patent [19]

Boulard

[11] Patent Number: 4,937,418

[45] Date of Patent: Jun. 26, 1990

[54] MICROWAVE OVEN FITTED WITH A WAVE SPREADER

[76] Inventor: Michel Boulard, 11 rue de Metz, 80000 Amiens, France

[21] Appl. No.: 361,955

[22] Filed: Jun. 6, 1989

[30] Foreign Application Priority Data

Jun. 7, 1988 [FR] France ..... 88 07554

[51] Int. Cl.[5] ..... H05B 6/74

[52] U.S. Cl. ..... 219/10.55 F; 219/10.55 A

[58] Field of Search ..... 219/10.55 F, 10.55 A, 219/10.55 R, 10.55 E; 99/451, DIG. 14

[56] References Cited

U.S. PATENT DOCUMENTS

| | | | |
|---|---|---|---|
| 3,265,780 | 8/1966 | Long | 219/10.55 F |
| 4,208,562 | 6/1980 | Perreault | 219/10.55 R |
| 4,221,948 | 9/1980 | Jean | 219/10.55 A |
| 4,370,534 | 1/1983 | Brandon | 219/10.55 A |
| 4,460,814 | 7/1984 | Diesch et al. | 219/10.55 F |
| 4,571,473 | 2/1986 | Wyslouzil et al. | 219/10.55 A |
| 4,751,357 | 6/1988 | Boulard | 219/10.55 R |
| 4,773,317 | 9/1988 | Wickboldt, Jr. | 219/10.55 F |

FOREIGN PATENT DOCUMENTS

| | | |
|---|---|---|
| 0225307 | 6/1987 | European Pat. Off. . |
| 2312165 | 12/1976 | France . |
| 2065458 | 7/1981 | United Kingdom . |

*Primary Examiner*—Philip H. Leung

*Attorney, Agent, or Firm*—Sixbey, Friedman, Leedom & Ferguson

[57] ABSTRACT

A microwave oven comprising an enclosure (1) in which a receptacle (2) is disposed, at least one source (3) of microwaves disposed above the receptacle, and a wave spreader (5) mounted to rotate between the microwave source and the inside of the receptacle. The wave spreader comprises at least one tubular waveguide (12, 13) disposed substantially vertically, extending inside the receptacle, and including at least one wave-receiving opening in the vicinity of its top portion and at least one wave-diffusing opening (16, 17) opening out to the inside of the receptacle. The oven also includes means (25) for preventing the receptacle from rotating about a vertical axis.

10 Claims, 1 Drawing Sheet

MICROWAVE OVEN FITTED WITH A WAVE SPREADER

The present invention relates to a microwave oven fitted with a wave spreader.

BACKGROUND OF THE INVENTION

In order to obtain uniform heating in a microwave oven, it is generally necessary to provide a wave spreader. In existing devices, a microwave oven generally comprises an enclosure in which a receptacle is disposed, one or more microwave sources disposed above the receptacle, and a wave spreader in the form of an antenna which is mounted to rotate between the microwave source and the inside of the receptacle. This type of spreader has the advantage of spreading the waves uniformly over the surface of the substance contained in the receptacle. However, the waves penetrate into the substance to be heated only to a limited depth such that when the receptacle contains a large quantity of substance to be heated, a portion of the substance is not reached by the waves.

The Applicant has already provided a solution to this problem, as described in French patent No. 2 588 063, by providing a microwave oven including means for stirring the substance contained in the receptacle, thereby causing all of the substance to be subjected to microwaves in order to obtain a uniform temperature of the substance inside the receptacle. However, homogenization can be obtained only insofar as the substance is stirred sufficiently to bring it regularly into a zone which is subjected to microwaves. In some cases, such stirring can be difficult, for example when the substance to be heated is fragile and must be stirred as gently as possible.

An object of the invention is to propose a microwave oven fitted with a wave spreader making it possible to make the temperature distribution inside the receptacle more uniform while minimizing the stirring to which the substance is subjected.

SUMMARY OF THE INVENTION

In order to achieve this object, the present invention provides a microwave oven comprising an enclosure in which a receptacle is disposed, at least one source of microwaves disposed above the receptacle, and a wave spreader mounted to rotate between the microwave source and the inside of the receptacle, in which the wave spreader comprises at least one tubular waveguide disposed substantially vertically, extending inside the receptacle, and including at least one wave-receiving opening in the vicinity of its top portion and at least one wave-diffusing opening opening out to the inside of the receptacle, the oven preferably including means for preventing the receptacle from rotating about a vertical axis.

Thus, a portion of the waves which would otherwise be stopped in the top layer of the substance contained in the receptacle penetrates into the bulk of the substance via the waveguide tubes and escapes via the wave-diffusing openings in order to heat the bulk of the substance contained in the receptacle from the inside, with rotation of the wave spreader ensuring that the waves thus distributed inside the bulk of the substance are distributed uniformly, even if the wave spreader rotates slowly.

According to an advantageous aspect of the invention, the tubular waveguide includes at least one lateral wave-diffusing opening; at least one wave deflector disposed in the vicinity of the lateral wave-diffusing opening, and preferably a first wave deflector facing a wall of the waveguide which is opposite to the lateral opening, and disposed upstream from the lateral opening in the direction of microwave propagation, and a second wave deflector facing the lateral opening of the waveguide, and disposed downstream from the lateral opening in the direction of microwave propagation.

In accordance with other advantageous aspects of the invention, the wave spreader comprises at least two waveguides having lateral wave-diffusing openings at different levels. This increases the speed with which the temperature in the bulk of the substance is made uniform.

According to yet another advantageous aspect of the invention, the wave-receiving openings and the wave-diffusing openings are closed by microwave-permeable material. This prevents the waveguide being obstructed by the substance contained in the receptacle while allowing the desired wave diffusion to take place.

BRIEF DESCRIPTION OF THE DRAWINGS

An embodiment of the invention is described by way of example with reference to the accompanying drawings, in which.

DETAILED DESCRIPTION

Figure 1:
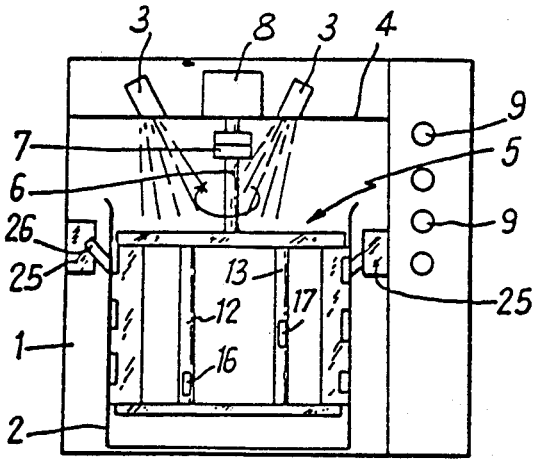
FIG. 1 is a diagram of an oven in accordance with the invention.
Figure 3:
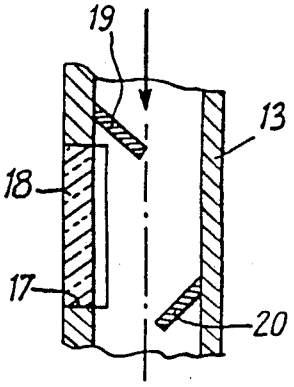
FIG. 3 is an axial section on a larger scale through a fragment of a waveguide and as seen along arrow III of FIG. 2.
Figure 2:
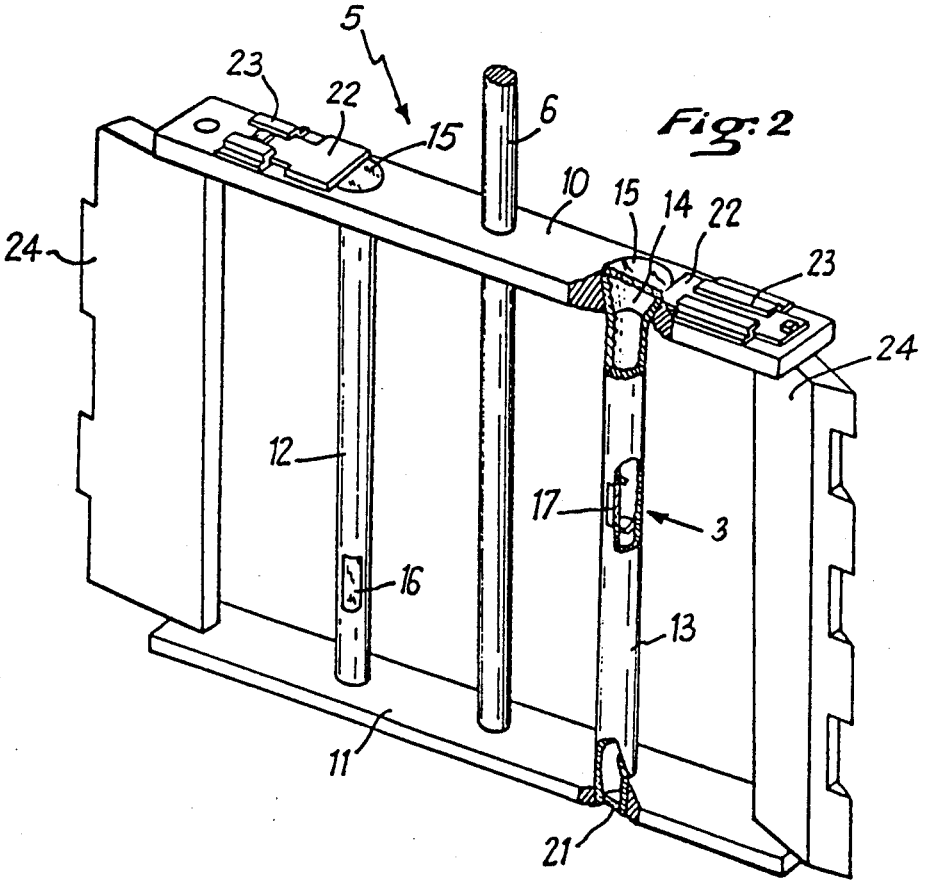
FIG. 2 is a partially cut-away perspective view of a wave spreader in accordance with the invention.

With reference to the drawings, the microwave oven comprises, in conventional manner, an enclosure 1 having a receptacle 2 disposed therein with two microwave generators 3 disposed above the receptacle and separated from the receptacle by a wave-permeable protective screen 4. A wave spreader given a general reference numeral 5 has a drive shaft 6 fixed to a rotary drive motor 8 via a coupling 7. The oven also includes a control circuit having control knobs 9 associated therewith.

In accordance with the invention, the wave spreader comprises a top cross-member 10 fixed to the drive shaft 6, and a bottom cross-member 11 connected to the top cross-member 10 by two tubular waveguides 12 and 13. The top ends of the tubular waveguides open out via wave-receiving openings in the top face of the cross-member 10. The top end of each of the waveguides 12 and 13 has a funnel shape 14 and the corresponding wave-receiving opening is covered with a wavepermeable material, e.g. a glass plate 15. Near to its bottom end, the waveguide 12 has a lateral wave-diffusing opening 16, and about halfway along, the waveguide 13 includes a lateral wave-diffusing opening 17. Each of the wave-diffusing openings 16 and 17 is closed by a microwave permeable material, e.g. a curved plate of glass 18. Upstream (in the microwave propagation direction) from its lateral wave-diffusing opening, the waveguide 13 includes a first deflector 19 facing towards the wall of the waveguide which is opposite to its lateral opening, and downstream (in the microwave propagation direction) from the lateral opening, the waveguide 13 includes a second wave deflector 20 facing the lateral opening of the waveguide. The bottom ends of the waveguides open out through the bottom face of the cross-member 11 via respective second wave-diffusing openings closed by means of glass plates 21.

The cross-member 10 has adjustment flaps 22 fitted on its top face to slide in slideways 23. The adjustment flaps 22 are made of microwave-proof material and they serve to adjust the quantity of microwaves which penetrate into the waveguides.

In the preferred embodiment, as shown, the cross-members 10 and 11 are fitted with scrapers 24 at their ends, which scrapers bear against the inside wall of the receptacle 2 while the wave spreader 5 is rotating.

When the wave spreader is rotated in thick material, the receptacle runs the risk of being rotated about a vertical axis. In order to prevent such rotation, abutments 25 are provided inside the enclosure 1, fixed to the side walls of the enclosure, and the handles 26 of the receptacle bear against the abutments. If the receptacle used does not have handles, it is naturally possible to provide other means for preventing the receptacle 2 from rotating about a vertical axis.

In use, the wave spreader of the invention is inserted into the receptacle containing the substance to be heated and then the receptacle is inserted in the enclosure 1 and the wave spreader drive shaft 6 is coupled to the motor 8. When the microwave generators 3 are in operation, some of the waves penetrate directly into the top layer of the substance contained in the receptacle 2, whereas another portion of the waves penetrates into the waveguides 12 and 13, and the fraction penetrating therein depends on the opening set by the adjustment flaps 22. In particular, if the depth of the substance to be heated does not reach the lateral wavediffusing opening 17 in waveguide 13, then the associated adjustment flap could be completely closed.

Naturally, the invention is not limited to the embodiment described and modifications may be made thereto without going beyond the scope of the invention. In particular, if it is desirable to increase the stirring effect within the substance to be heated, then the number of waveguides could be increased. In this context, it may also be observed that the present invention is complementary to the invention described in French patent No. 2 588 063 and may be applied thereto.

In addition, the microwave oven of the invention may be fitted with other accessories, in particular with a temperature probe disposed on the surface of the drive shaft 6 or inside it and connected to a measuring device via a slip ring disposed at the top end of the drive shaft 6.

When the microwave oven is to be used for sterilizing purposes or for cooking pieces of solid substances, cells or small cages may be fastened at different levels on the wave spreader of the invention for the purpose of retaining the pieces of substance during rotation of the wave spreader.

When using a tubular drive shaft, it is also possible to provide a lateral wave-receiving opening close to the top portion of the drive shaft together with one or more lateral wave-diffusing openings inside the receptacle 2. Naturally, the wave-diffusing openings may also be at different orientations so that the diffused wave beams cover the entire inside volume of the receptacle during rotation of the wave spreader.

Although the oven described has its microwave generators provided above the receptacle, it is also possible to use a microwave oven having its generators disposed laterally, with the sources for directing microwaves inside the receptacle then being constituted by fixed or moving deflectors disposed above the receptacle.

It is also possible to provide a tubular waveguide coaxially with the drive shaft 6, or else to replace the drive shaft with such a waveguide, said waveguide opening out near the top of the oven to face a wave generator reserved for this waveguide, if necessary together with a conical deflector disposed facing the top end of the waveguide. Such a waveguide coaxial with the drive shaft 6 may also be associated with tubular cross-members 10 fitted with deflectors for spreading the waves in lateral waveguides.

I claim:

1. A microwave oven comprising an enclosure in which a receptacle is disposed, at least one source of microwaves disposed above the receptacle for sending microwaves toward said receptacle, and a wave spreader mounted to rotate about a rotational axis between the microwave source and the inside of the receptacle, wherein the wave spreader comprises at least one tubular waveguide located at a distance from said rotational axis disposed substantially vertically, extending inside the receptacle, and including at least one wave-receiving opening in the vicinity of its top portion and at least one wave-diffusing opening opening out to the inside of the receptacle.

2. A microwave oven according to claim 1, wherein the tubular waveguide includes, at least one lateral wave-diffusing opening.

3. A microwave oven according to claim 2, wherein the waveguide includes at least one wave deflector disposed in the vicinity of the lateral wave-diffusing opening.

4. A microwave oven according to claim 3, wherein the waveguide includes a first wave deflector facing a wall of the waveguide which is opposite to the lateral opening, said deflector being disposed upstream from the lateral opening in the direction of microwave propagation, and a second wave deflector facing the lateral opening of the waveguide, said second wave deflector being disposed downstream from the lateral opening in the direction of microwave propagation.

5. A microwave oven according to claim 1, wherein said at least one wave-receiving opening is disposed at the top end of the waveguide.

6. A microwave oven according to claim 5, wherein the top end of the waveguide is funnel-shaped.

7. A microwave oven according to claim 1, wherein the wave spreader comprises at least two waveguides each having one lateral wave-diffusing opening, the wave-diffusing openings of said at least two waveguides being located at different levels.

8. A microwave oven according to claim 1, wherein said at least one wave-receiving opening and said at least one wave-diffusing opening are closed by microwave-permeable material.

9. A microwave oven according to claim 1, wherein at least one wave-receiving opening is fitted with at least one moving adjustment flap made of microwave-proof material.

10. A microwave oven according to claim 1, including means for preventing the receptacle from rotating about a vertical axis.

* * * * *